US010424203B2

(12) United States Patent
Gunaratne

(10) Patent No.: US 10,424,203 B2
(45) Date of Patent: Sep. 24, 2019

(54) SYSTEM AND METHOD FOR DRIVING HAZARD ESTIMATION USING VEHICLE-TO-VEHICLE COMMUNICATION

(71) Applicant: Toyota Motor Engineering & Manufacturing North America, Inc., Erlanger, KY (US)

(72) Inventor: Pujitha Gunaratne, Windsor (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/010,069

(22) Filed: Jan. 29, 2016

(65) Prior Publication Data

US 2017/0221362 A1 Aug. 3, 2017

(51) Int. Cl.
*G08G 1/16* (2006.01)
*G08G 1/0967* (2006.01)

(52) U.S. Cl.
CPC ..... *G08G 1/163* (2013.01); *G08G 1/096716* (2013.01); *G08G 1/096791* (2013.01); *G08G 1/166* (2013.01)

(58) Field of Classification Search
USPC ..... 701/301
See application file for complete search history.

(56) References Cited

U.S. PATENT DOCUMENTS 5,983,161 A * 11/1999 Lemelson ..... G01S 19/11 340/436
6,259,976 B1 * 7/2001 Lemelson ..... B64C 13/16 244/110 B
6,317,058 B1 * 11/2001 Lemelson ..... G08G 1/07 340/905
6,778,097 B1 * 8/2004 Kajita ..... E02F 3/437 340/12.5
7,124,027 B1 * 10/2006 Ernst, Jr. ..... B60W 30/09 701/301
7,164,117 B2 * 1/2007 Breed ..... B60R 21/01516 250/208.1
7,991,551 B2 8/2011 Samuel et al.
8,331,611 B2 * 12/2012 Johnson, II ..... G06F 16/70 382/100
8,558,847 B2 * 10/2013 Knize ..... G01C 21/20 345/629

(Continued)

OTHER PUBLICATIONS

Yang et al., "A Vehicle-to-Vehicle Communication Protocol for Cooperative Collision Warning", Proceedings of the First Annual International Conference on Mobile and Ubiquitous Systems: Networking and Services, IEEE, 2004, (10 pages).

(Continued)

*Primary Examiner* — Jean Paul Cass
(74) *Attorney, Agent, or Firm* — Christopher G. Darrow; Darrow Mustafa PC

(57) ABSTRACT

A computing device for a vehicle hazard avoidance system. The device includes one or more processors for controlling operation of the computing device, and a memory storing computer-executable instructions which, when executed by the one or more processors, cause the computing device to receive hazard assessment information relating to a vehicle, perform an analysis of the hazard assessment information, and generate a hazard assessment based on the analysis.

12 Claims, 8 Drawing Sheets

(56) References Cited

U.S. PATENT DOCUMENTS 8,614,633 B1 * 12/2013 Lear ..... G08B 29/188 114/382
8,688,375 B2 * 4/2014 Funk ..... G01C 21/165 340/995.19
9,104,535 B1 8/2015 Brinkmann et al.
9,229,540 B2 * 1/2016 Mandella ..... G06F 3/03545
9,401,540 B2 * 7/2016 Osterhout ..... H01Q 1/273
9,494,800 B2 * 11/2016 Border ..... G02B 27/0172
9,607,015 B2 * 3/2017 Gao ..... G06F 17/2765
9,609,107 B2 * 3/2017 Rodriguez ..... G01C 21/20
9,783,169 B2 * 10/2017 Seiter ..... B60T 7/22
2003/0152186 A1 * 8/2003 Jurczyk ..... G21B 1/19 376/109
2003/0210176 A1 * 11/2003 Hager ..... G01S 7/292 342/118
2003/0210177 A1 * 11/2003 Hager ..... G01S 7/292 342/147
2003/0210178 A1 * 11/2003 Hager ..... G01S 7/292 342/159
2003/0210185 A1 * 11/2003 Hager ..... G01S 7/292 342/194
2003/0214431 A1 * 11/2003 Hager ..... G01C 21/005 342/115
2003/0230161 A1 * 12/2003 Snell ..... B60T 7/085 74/552
2005/0046584 A1 * 3/2005 Breed ..... B60C 11/24 340/13.31
2006/0058928 A1 * 3/2006 Beard ..... G01C 23/005 701/11
2006/0208169 A1 * 9/2006 Breed ..... B60N 2/002 250/221
2009/0254572 A1 * 10/2009 Redlich ..... G06Q 10/06
2009/0326792 A1 * 12/2009 McGrath ..... G01W 1/08 701/120
2010/0250106 A1 9/2010 Bai et al.
2010/0250497 A1 * 9/2010 Redlich ..... F41H 13/00 707/661
2011/0098029 A1 * 4/2011 Rhoads ..... G01C 21/3629 455/418
2011/0210866 A1 * 9/2011 David ..... G08G 1/163 340/903
2011/0244919 A1 * 10/2011 Aller ..... G06K 9/00973 455/556.1
2012/0044066 A1 * 2/2012 Mauderer ..... B60T 7/22 340/479
2013/0060443 A1 * 3/2013 Shida ..... B60K 31/0008 701/96
2013/0154853 A1 6/2013 Chen
2013/0226408 A1 * 8/2013 Fung ..... B60W 40/09 701/41
2013/0229289 A1 * 9/2013 Bensoussan ..... B60Q 5/006 340/902
2014/0035736 A1 * 2/2014 Weddle ..... G05D 1/005 340/407.2
2014/0249741 A1 * 9/2014 Levien ..... G05D 1/12 701/302
2015/0042491 A1 * 2/2015 Burnison ..... B60Q 1/52 340/902
2015/0066346 A1 * 3/2015 Cheatham, III ..... G08G 1/166 701/301
2015/0332114 A1 * 11/2015 Springer ..... G06K 9/4604 348/148
2015/0362733 A1 * 12/2015 Spivack ..... A63F 13/26 345/633
2016/0001781 A1 * 1/2016 Fung ..... B60W 40/08 701/36
2016/0267720 A1 * 9/2016 Mandella ..... G06T 19/006
2017/0221362 A1 * 8/2017 Gunaratne ..... G08G 1/163
2018/0022358 A1 * 1/2018 Fung ..... B60W 40/08 701/36
2018/0130004 A1 * 5/2018 Morgheim ..... G06Q 10/06395

OTHER PUBLICATIONS

Gunaratne et al., "A Closed-Loop Crash Warning System based on Heterogeneous Cues", Proceedings of the 5th International Conference on Automation, Robotics and Applications, Dec. 6-8, 2011, Wellington, New Zealand, (4 pages).

* cited by examiner

SYSTEM AND METHOD FOR DRIVING HAZARD ESTIMATION USING VEHICLE-TO-VEHICLE COMMUNICATION

TECHNICAL FIELD

The present disclosure relates to systems directed to promoting hazard detection and avoidance in vehicles driving in relatively close proximity to each other.

BACKGROUND

Each vehicle driving on a roadway must interact with other nearby vehicles. In high-speed, dynamic driving environments, the number and composition of vehicles driving near a given vehicle are constantly changing. In addition, each of the vehicles driving near the given vehicle at any given time may pose a particular hazard or collision risk to the given vehicle. Thus, the threat environment in which the given vehicle is driving is constantly changing. Consequently, there is a need for a system which provides an ongoing, real-time assessment of potential short-term collision hazards posed by each vehicle driving within a predetermined distance of a given vehicle.

SUMMARY

In one aspect of the embodiments described herein, a computing device for a vehicle hazard avoidance system is provided. The device includes one or more processors for controlling operation of the computing device, and a memory storing computer-executable instructions which, when executed by the one or more processors, cause the computing device to receive hazard assessment information relating to a vehicle, perform an analysis of the hazard assessment information, and generate a hazard assessment based on the analysis.

In another aspect of the embodiments of the described herein, a method is provided for estimating a collision hazard to a first vehicle posed by at least one second vehicle driving within a predetermined distance of the first vehicle. The method includes steps of receiving, from the at least one second vehicle, hazard assessment information relating to the second vehicle, performing an analysis of the hazard assessment information, and generating a hazard assessment based on the analysis.

In another aspect of the embodiments of the described herein, a computing device for a vehicle hazard avoidance system is provided. The device includes one or more processors for controlling operation of the computing device, and a memory storing computer-executable instructions which, when executed by the one or more processors, cause the computing device to receive hazard assessment information relating to a first vehicle; generate, using the hazard assessment information relating to a first vehicle, a hazard assessment token; transmit the hazard assessment token to at least one second vehicle traveling within a predetermined distance from the first vehicle; receive, from the at least one second vehicle, hazard assessment information relating to the at least one second vehicle; perform an analysis of the hazard assessment information relating to the at least one second vehicle; and generate a hazard assessment relating to the at least one second vehicle based on the analysis.

Other features and advantages of the disclosure will be apparent from the additional description provided herein.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION

Figure 1:
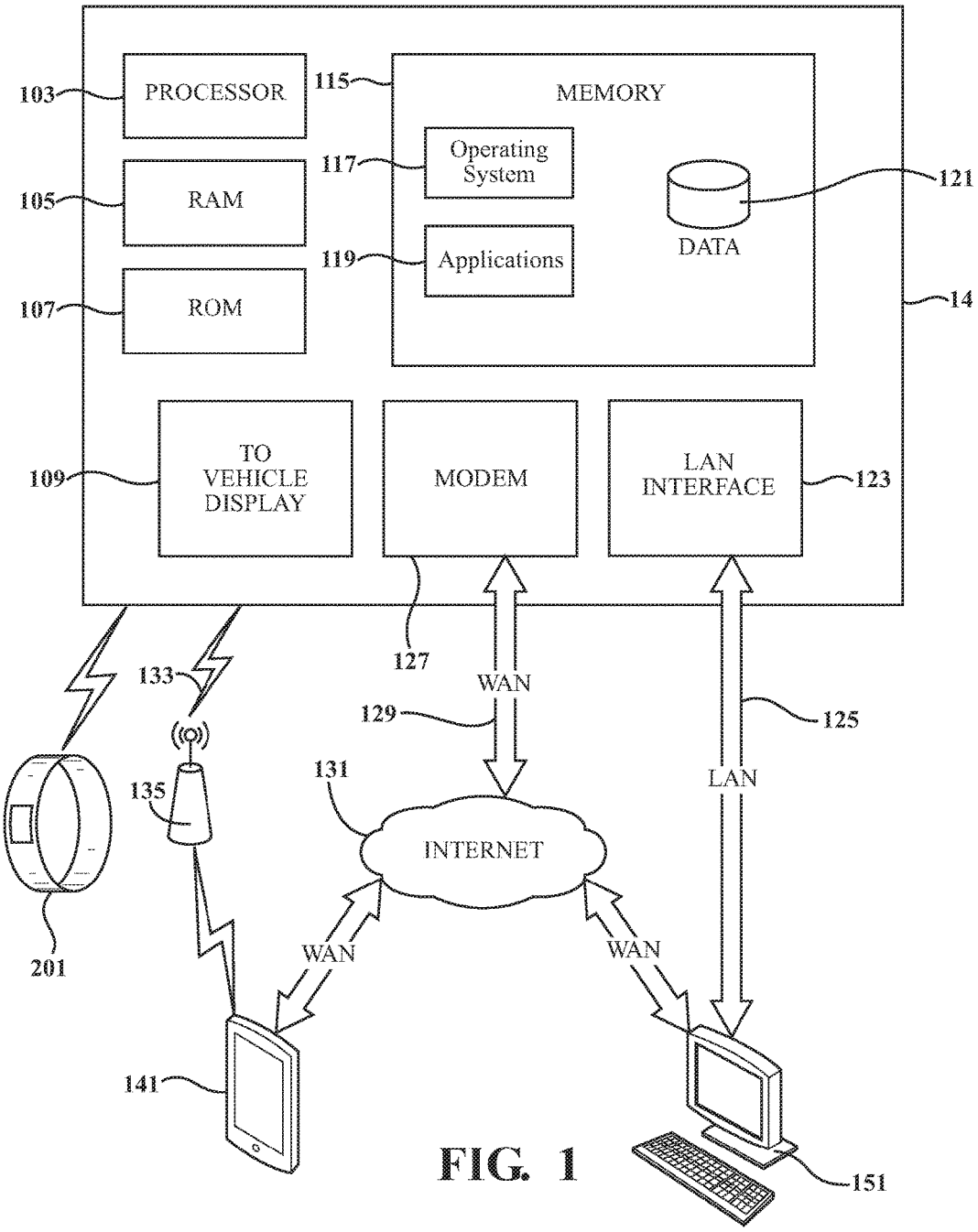
FIG. 1 illustrates a network environment and computing systems that may be used to implement aspects of the disclosure.

The present disclosure describes embodiments of a vehicle hazard avoidance system designed to provide an ongoing, real-time assessment of potential short-term collision hazards posed by each vehicle driving within a predetermined distance of a receiving or host vehicle.

In one embodiment, the predetermined distance is determined by a range of a vehicle-to-vehicle (V2V) communications network including the receiving vehicle and all other vehicles within V2V transmission/reception range of the receiving vehicle. The collection of vehicles within the predetermined distance may define a local cluster of vehicles.

For the purposes described herein, a receiving vehicle is a vehicle incorporating an exemplary hazard avoidance computing device or system as described herein, and which receives hazard assessment information from one or more other vehicles in the local cluster for analysis and use in calculating hazard assessments relating to those other vehicles. A transmitting vehicle is a vehicle which gathers its own pertinent hazard assessment data, generates a token using the data, and transmits the token to other vehicles within the predetermined distance. Thus, each individual vehicle in the local cluster effectively becomes a receiving vehicle which is the locus of a local cluster of nearby vehicles driving within communications range of the receiving vehicle. Each individual vehicle in the local cluster is also a transmitting vehicle, which gathers hazard assessment data from its sensors, generates a hazard assessment token using the data, and transmits the token to other vehicles in the local cluster for analysis.

Since individual vehicles may constantly enter or leave the local cluster or transmission/reception range of the receiving vehicle, the composition of the local cluster surrounding any receiving vehicle may vary on a continuous basis. Thus, the vehicles constituting the local cluster and other vehicles outside the local cluster equipped with and/or configured to communicate with the hazard avoidance system may be configured to constantly gather hazard assessment data, generate hazard assessment tokens using this data, transmit the tokens to other vehicles within communications range of the transmitting vehicle, receive the tokens, analyze the information contained in the tokens, and generate hazard assessments as described herein. The received tokens are constantly analyzed as described herein to provide an ongoing, real-time assessment of potential short-term collision hazards posed by each transmitting vehicle to the receiving vehicle. This hazard assessment can be transmitted to a driver or other vehicle occupant so that collision or hazard avoidance action may be taken prior to an accident.

In the following description of the various embodiments, reference is made to the accompanying drawings, which form a part hereof, and in which is shown by way of illustration, various embodiments of the disclosure that may be practiced. It is to be understood that other embodiments may be utilized.

As will be appreciated by one of skill in the art upon reading the following disclosure, various aspects described herein may be embodied as a method, a computer system, or a computer program product. Accordingly, those aspects may take the form of an entirely hardware embodiment, an entirely software embodiment or an embodiment combining software and hardware aspects. Furthermore, such aspects may take the form of a computer program product stored by one or more computer-readable storage media having computer-readable program code, or instructions, embodied in or on the storage media. Any suitable computer readable storage media may be utilized, including hard disks, CD-ROMs, optical storage devices, magnetic storage devices, and/or any combination thereof. In addition, various signals representing data or events as described herein may be transferred between a source and a destination in the form of electromagnetic waves traveling through signal-conducting media such as metal wires, optical fibers, and/or wireless transmission media (e.g., air and/or space).

FIG. 1 illustrates a block diagram of a computing device 14 in hazard avoidance system 200 that may be used according to one or more illustrative embodiments of the disclosure. The hazard avoidance computing device 14 may have one or more processors 103 for controlling overall operation of the device 14 and its associated components, including RAM 105, ROM 107, input/output module or HMI (human machine interface) 109, and memory 115. The computing device 14, along with one or more additional devices (e.g., terminals 141, 151) may correspond to any of multiple systems or devices, such as a hazard avoidance computing devices or systems, configured as described herein for transmitting and receiving vehicle-to-vehicle (V2V) communications, collecting and/or receiving hazard assessment information, generating hazard assessment tokens using the hazard assessment information, analyzing hazard assessment token values, and calculating hazard assessments as described herein, based on the V2V communications.

Computing device 14 may also include (or be in operative communication with) any filters or other processing hardware needed to integrate or otherwise process data received from the sensors. One or more of the vehicle computing devices may be configured to continuously receive hazard assessment data, generate hazard assessment tokens using the received data, and transmit the hazard assessment tokens to nearby vehicles. One or more of the vehicle computing devices may also be configured to continuously receive hazard assessment tokens, analyze the hazard assessment tokens, and generate hazard assessments.

Input/Output (I/O) 109 may include a microphone, keypad, touch screen, and/or stylus through which a user of the computing device 14 may provide input, and may also include one or more of a speaker for providing audio output and a video display device for providing textual, audiovisual and/or graphical output. Software may be stored within memory 115 and/or storage to provide instructions to processor 103 for enabling device 14 to perform various functions. For example, memory 115 may store software used by the device 14, such as an operating system 117, application programs 119, and an associated internal database 121. Processor 103 and its associated components may allow the hazard avoidance system 200 to execute a series of computer-readable instructions to transmit or receive hazard assessment tokens and/or other information, generate hazard assessment tokens, analyze the hazard assessment tokens and/or other information, and calculate hazard assessments based on the analysis.

The hazard avoidance computing device 14 may operate in a networked environment supporting connections to one or more remote computers, such as terminals/devices 141 and 151. Hazard avoidance computing device 14, and related terminals/devices 141 and 151, may include devices installed in vehicles, mobile devices that may travel within vehicles, or devices outside of vehicles that are configured to receive hazard assessment information, generate hazard assessment tokens, receive and analyze and hazard assessment tokens, and/or generate hazard assessments based on analysis of hazard assessment tokens. Thus, the hazard avoidance computing device 14 and terminals/devices 141 and 151 may each be embodied in personal computers (e.g., laptop, desktop, or tablet computers), servers (e.g., web servers, database servers), vehicle-based devices (e.g., on-board vehicle computers, short-range vehicle communication systems, telematics devices), or mobile communication devices (e.g., mobile phones, portable computing devices, and the like), and may include some or all of the elements described above with respect to the hazard avoidance computing device 14. In addition, any of these computing device embodiments may include a haptic interface or may be configured to provide haptic feedback to a vehicle occupant to inform the occupant of a change in automation status, an active or pending alert, or any other automation status or condition which should be communicated to the occupant. The network connections depicted in FIG. 1 may include a local area network (LAN) 125 and a wide area network (WAN) 129, and a wireless telecommunications network 133, but may also include other networks. When used in a LAN networking environment, the hazard avoidance computing device 14 may be connected to the LAN 125 through a network interface or adapter 123. When used in a WAN networking environment, the device 14 may include a modem 127 or other means for establishing communications over the WAN 129, such as network 131 (e.g., the Internet). When used in a wireless telecommunications network 133, the device 14 may include one or more transceivers, digital signal processors, and additional circuitry and software for communicating with wireless computing devices 141 (e.g., mobile phones, short-range vehicle communication systems, vehicle telematics devices) via one or more network devices 135 (e.g., base transceiver stations) in the wireless network 133.

It will be appreciated that the network connections shown are illustrative and other means of establishing a communications link between the computers may be used. The existence of any of various network protocols such as TCP/IP, Ethernet, FTP, HTTP and the like, and of various wireless communication technologies such as GSM, CDMA, WiFi, and WiMAX, is presumed, and the various computing devices and hazard avoidance system components described herein may be configured to communicate using any of these network protocols or technologies. Additionally, one or more application programs 119 used by the hazard avoidance computing device 14 may include computer executable instructions (e.g., hazard assessment analysis programs and algorithms) for receiving hazard assessment information, generating hazard assessment tokens, transmitting and receiving hazard assessment tokens, analyzing hazard assessment tokens, and calculating hazard assessments for one or more vehicles, and performing other related functions as described herein.

As used herein, a "hazard assessment" or "hazard assessment value" may refer to a measurement of the potential collision hazard to the receiving vehicle posed by another particular vehicle of the local cluster (i.e., driving within a predetermined distance of the receiving vehicle).

Figure 2:
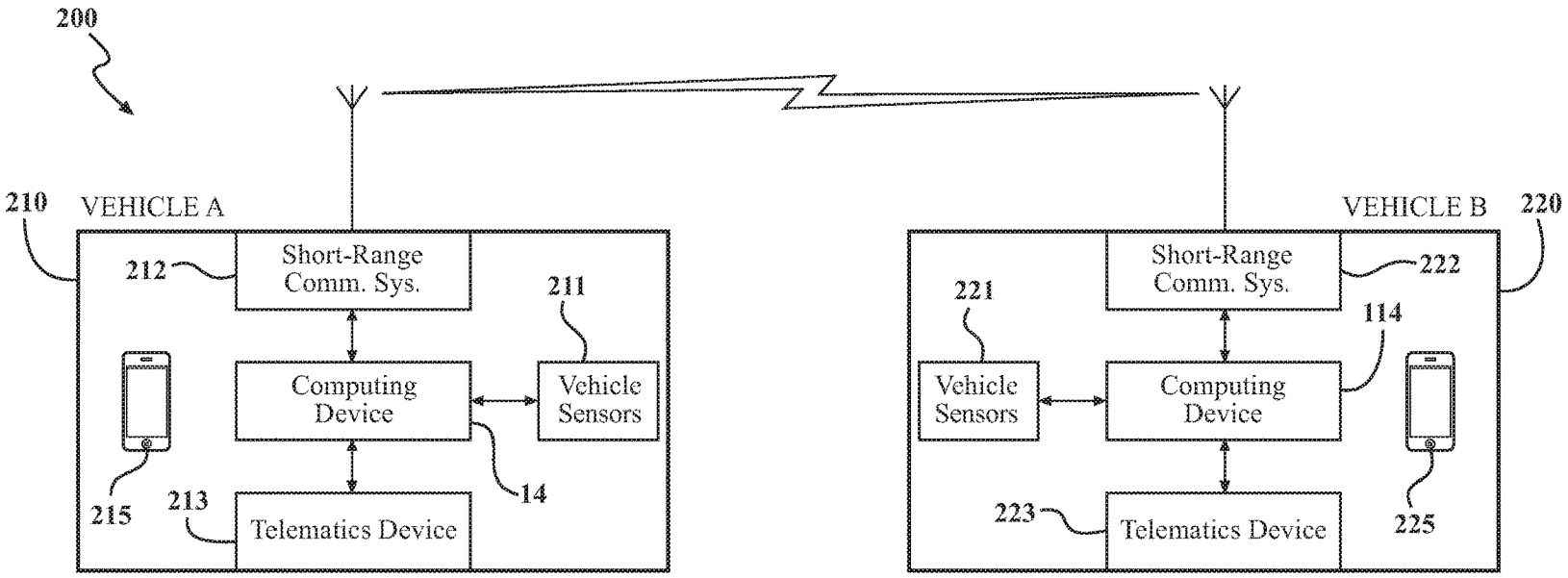
FIG. 2 is a diagram illustrating various components and devices of a hazard avoidance system, according to one or more aspects of the disclosure.

FIG. 2 is a diagram of an illustrative hazard avoidance system 200 and additional related components. Each component shown in FIG. 2 may be implemented in hardware, software, or a combination of the two. Additionally, each component of the hazard avoidance system 200 may include a computing device (or system) having some or all of the structural components described above for computing device 14. Vehicle 210 includes a computing device 14 similar to that described previously, and vehicle 220 includes a computing device 114 similar to that described previously.

Vehicles 210 and 220 in the hazard avoidance system 200 may be, for example, automobiles, motorcycles, scooters, buses, recreational vehicles, boats, or other vehicles for which a hazard assessment data may be analyzed and for which hazard assessments may be calculated. The vehicles 210 and 220 each include vehicle operation sensors 211 and 221 capable of detecting and recording various conditions at the vehicle and operational parameters of the vehicle. For example, sensors 211 and 221 may detect and store data corresponding to the vehicle's location (e.g., GPS coordinates), speed and direction, rates of acceleration or braking, and specific instances of sudden acceleration, braking, and swerving. Sensors 211 and 221 also may detect and store data received from the vehicle's 210 internal systems, such as impact to the body of the vehicle, air bag deployment, headlights usage, brake light operation, door opening and closing, door locking and unlocking, cruise control usage, hazard lights usage, windshield wiper usage, horn usage, turn signal usage, seat belt usage, phone and radio usage within the vehicle, maintenance performed on the vehicle, and other data collected by the vehicle's computer systems.

Additional sensors 211 and 221 may detect and store the external driving conditions, for example, external temperature, rain, snow, light levels, and sun position for driver visibility. For example, external cameras and proximity sensors 211 and 221 may detect other nearby vehicles, traffic levels, road conditions, traffic obstructions, animals, cyclists, pedestrians, and other conditions that may factor into a hazard assessment analysis. Additional sensors 211 and 221 may detect and store data relating to the maintenance of the vehicles 210 and 220, such as the engine status, oil level, engine coolant temperature, odometer reading, the level of fuel in the fuel tank, engine revolutions per minute (RPMs), and/or tire pressure.

Vehicles sensors 211 and 221 also may include cameras and/or proximity sensors capable of recording additional conditions inside or outside of the vehicles 210 and 220. For example, internal cameras may detect conditions such as the number of the passengers and the types of passengers (e.g. adults, children, teenagers, pets, etc.) in the vehicles, and other potential sources of driver distraction within the vehicle (e.g., pets, phone usage, unsecured objects in the vehicle). Sensors 211 and 221 also may be configured to collect data a driver's movements or the condition of a driver. For example, vehicles 210 and 220 may include sensors that monitor a driver's movements, such as the driver's eye position and/or head position, etc. Additional sensors 211 and 221 may collect data regarding the physical or mental state of the driver, such as fatigue or intoxication. The condition of the driver may be determined through the movements of the driver or through other sensors, for example, sensors that detect the content of alcohol in the air or blood alcohol content of the driver, such as a breathalyzer.

In certain embodiments, sensors and/or cameras 211 and 221 may determine when and how often the vehicles 210 and 220 stay in a single lane or stray into other lanes. A Global Positioning System (GPS), locational sensors positioned inside the vehicles 210 and 220, and/or locational sensors or devices external to the vehicles 210 and 220 may be used determine vehicle route, lane position, and other vehicle position/location data. The data collected by vehicle sensors 211 and 221 may be stored and/or analyzed within the respective vehicles 210 and 220. Hazard assessment tokens containing this data and other information may also be transmitted to one or more external devices. For example, as shown in FIG. 2, hazard assessment tokens and/or other information may be transmitted via short-range communication systems 212 and 222 to other nearby vehicles. Additionally, the hazard assessment tokens and/or other information may be transmitted via telematics devices 213 and 223 to one or more remote computing devices.

Short-range communication systems 212 and 222 are vehicle-based data transmission systems configured to transmit hazard assessment tokens and other information to other nearby vehicles, and to receive hazard assessment tokens and/or other information from other nearby vehicles. In some examples, communication systems 212 and 222 may use the dedicated short-range communications (DSRC) protocols and standards to perform wireless communications between vehicles. In the United States, 75 MHz in the 5.850-5.925 GHz band have been allocated for DSRC systems and applications, and various other DSRC allocations have been defined in other countries and jurisdictions. However, short-range communication systems 212 and 222 need not use DSRC, and may be implemented using other short-range wireless protocols in other examples, such as WLAN communication protocols (e.g., IEEE 802.11), Bluetooth (e.g., IEEE 802.15.1), or one or more of the Communication Access for Land Mobiles (CALM) wireless communication protocols and air interfaces. The vehicle-to-vehicle (V2V) transmissions between the short-range communication systems 212 and 222 may be sent via DSRC, Bluetooth, satellite, GSM infrared, IEEE 802.11, WiMAX, RFID, and/or any suitable wireless communication media, standards, and protocols. In certain systems, short-range communication systems 212 and 222 may include specialized hardware installed in vehicles 210 and 220 (e.g., transceivers, antennas, etc.), while in other examples the communication systems 212 and 222 may be implemented using existing vehicle hardware components (e.g., radio and satellite equipment, navigation computers) or may be implemented by software running on the mobile devices 215 and 225 of drivers and passengers within the vehicles 210 and 220.

The range of V2V communications between vehicle communication systems 212 and 222 may depend on the wireless communication standards and protocols used, the transmission/reception hardware (e.g., transceivers, power sources, antennas), and other factors. Short-range V2V communications may range from just a few feet to many miles. V2V communications also may include vehicle-to-infrastructure (V2I) communications, such as transmissions from vehicles to non-vehicle receiving devices, for example, toll booths, rail road crossings, and road-side traffic monitoring devices. Certain V2V communication systems may periodically broadcast hazard assessment information from a vehicle 210 to any other vehicle, or other infrastructure device capable of receiving the communication, within the range of the vehicle's transmission capabilities. For example, a vehicle 210 may periodically broadcast (e.g., every 0.1 second, every 0.5 seconds, every second, every 5 seconds, etc.) a hazard assessment token containing hazard assessment information as described herein via its short-range communication system 212, regardless of whether or not any other vehicles or reception devices are in range. Alternatively, a cycle of hazard assessment token generation and transmission may be effected wherein a new, updated token is generated and transmitted as soon as new hazard assessment data can be gathered and processed to form the new token. This provides, to the greatest degree possible, real-time information regarding the potential hazard status of all the vehicles currently within the local cluster.

A vehicle communication system 212 may first detect nearby vehicles and receiving devices, and may initialize communication with each by performing a handshaking transaction before beginning to transmit hazard assessment tokens to the other vehicles and/or devices. New vehicles entering the local cluster may be detected by any of a variety of methods, for example, by radar or by reception by the receiving vehicle (from another vehicle configured for communication with elements of the hazard avoidance system) of a hazard assessment token from the new vehicle. When new vehicles are detected within the range encompassed by the local cluster, the hazard avoidance system may acknowledge incorporation of these vehicles into the local cluster by displaying a graphical representation of the vehicles on a visual interface or otherwise informing the driver of the receiving vehicle of the presence of the new vehicle in the local cluster.

Figure 3:
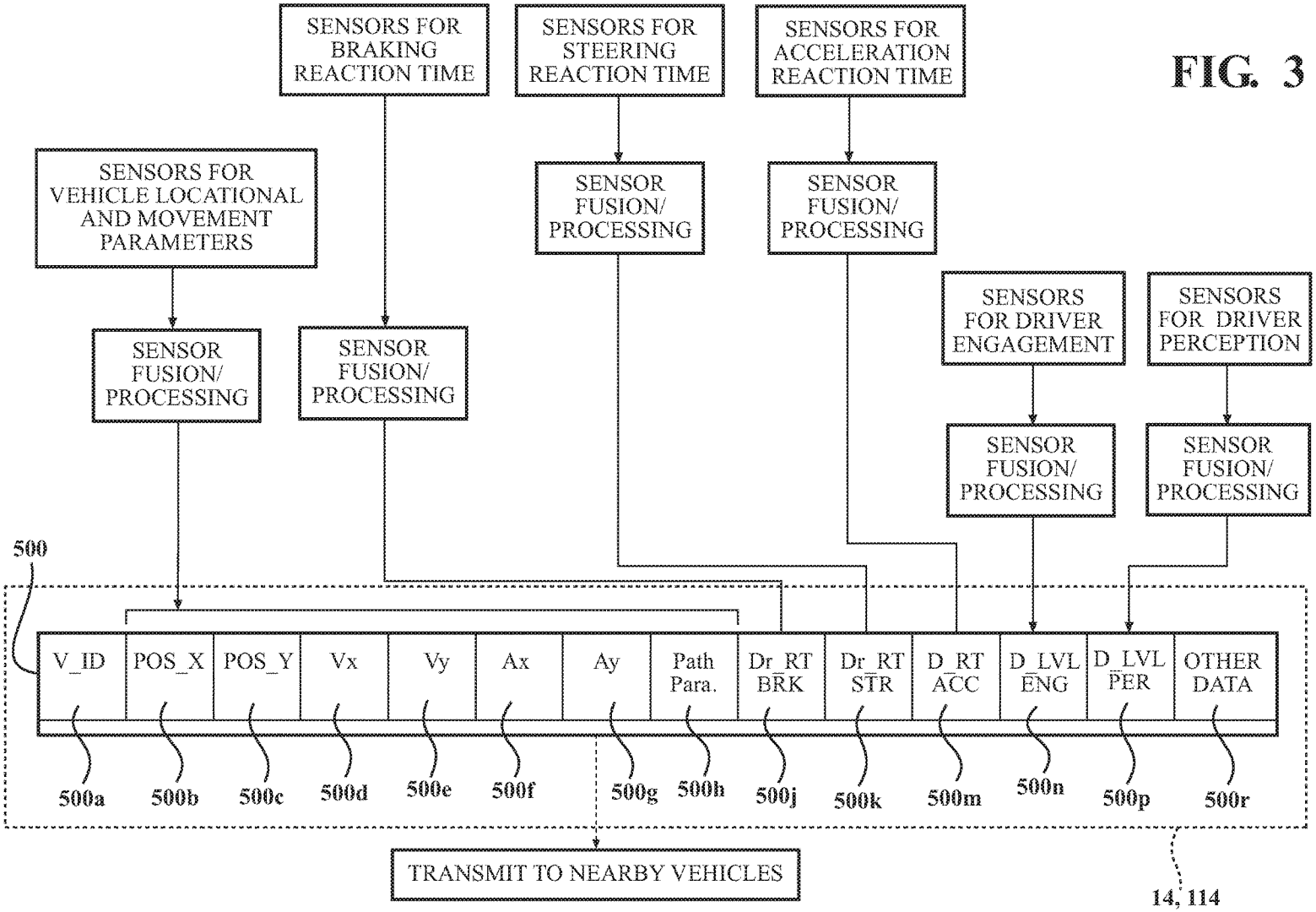
FIG. 3 is a schematic diagram illustrating the collection of hazard assessment data and the generation of a hazard assessment token for transmission to a nearby vehicle.

In embodiments described herein, vehicle operational and driver data sent to nearby vehicles is transmitted in the form of a token 500 as previously described. FIG. 3 is a schematic diagram illustrating the collection of hazard assessment data and the generation of a hazard assessment token for transmission to a nearby vehicle. In the embodiments described herein, hazard assessment data (i.e., vehicle operational data, driver data and any other pertinent data) is gathered by the vehicle sensors and is processed for transmission into the hazard assessment token 500, for transmission to nearby vehicles. The values stored in the various fields of the token 500 as described herein may be in any form suitable for the purposes described herein. For example, the values may be in the form of raw data received directly from a vehicle sensor, processed data (such as data processed using an A/D or D/A converter or a filter) and/or composite values generated by integrating or processing data from multiple sensors or sources using a filter or other processing means.

In the embodiment shown, the token 500 includes multiple data fields 500*a*-500*r*, with each field including a value of a parameter used to calculate the hazard assessment. Field 500*a* contains vehicle identification information (for example, the VIN of the vehicle generating the token). This identification information may be stored in a memory or may be collected from other sources, such as a vehicle occupant's mobile device 215 or 225 or any other suitable source. This information is used by the receiving vehicle(s) to identify the particular transmitting vehicle and to link all tokens sent by the transmitting vehicle to this vehicle.

Field 500*b* contains an x-coordinate of a position of the transmitting vehicle at a time when the information for token generation is gathered. Field 500*c* contains a y-coordinate of a position of the transmitting vehicle at a time when the information for token generation is gathered. Using the "x" and "y" position information in fields 500*b* and 500*c* and the known positional information of the receiving vehicle, the receiving vehicle can calculate the position of the transmitting vehicle with respect to the receiving vehicle.

Field 500*d* contains a velocity component vX of the transmitting vehicle in an "x" reference direction at a time when the information for token generation is gathered. Field 500*e* contains a velocity component vY of the transmitting vehicle in a "y" reference direction at a time when the information for token generation is gathered. The "x" and "y" reference directions can be determined in a known manner and will be consistent for all vehicles in the local cluster.

Field 500*f* contains an acceleration component aX of the transmitting vehicle in an "x" reference direction at a time when the information for token generation is gathered. Field 500*g* contains an acceleration component aY of the transmitting vehicle in a "y" reference direction at a time when the information for token generation is gathered.

Field 500*h* contains one or more vehicle path parameters indicative of the direction or current path of the vehicle in terms of "x" and "y" coordinates at a time when the information for token generation is gathered. The path parameter(s) may be calculated using successive or sequential GPS positional coordinates, for example, from an analysis of vehicle velocity components in the x and y directions to generate a net velocity vector, or any other known or suitable method.

The positional coordinates and velocity and acceleration information included in the token may include absolute locational information expressed in terms of GPS coordinates or any other suitable coordinate system, and/or in terms of a relative location with respect to another vehicle or a fixed point. In a particular embodiment, the positional coordinates and velocity and acceleration information are expressed in relational to a single fixed location, which facilitates calculation by the receiving vehicle of the positions, velocities and accelerations of the transmitting vehicles with respect to the receiving vehicle.

The above vehicle locational and movement information contained in each token provides the distances, bearing, heading, speed and acceleration of each respective transmitting vehicle with respect to the receiving vehicle and enables the positional statuses of the transmitting vehicles relative to any receiving vehicle to be shown on a visual display or otherwise presented to the driver in the receiving vehicle. This display or presentation may then be updated whenever a new, updated hazard assessment token is received and processed by the receiving vehicle, to provide up-to-the-moment status information regarding all the other vehicles in the local cluster.

In addition to vehicle locational and movement information, information relating to the driver may also be used in calculating hazard assessments. For example, in the embodiment shown, field 500*j* contains a value indicating an estimated braking reaction time of the driver of the transmitting vehicle. Factors affecting this value may include data gathered over time indicating the average speed or force with which the driver applies the brakes, vehicle sensor information relating to the mechanical condition of the brakes, and other pertinent information. Data from each of the sensor readings or variables used for assessing estimated braking reaction time may be quantified and subjected to a sensor fusion process (using a Kalman filter, for example) or otherwise integrated to form a composite value representing an estimated braking reaction time of the driver. This value is included in field 500*j* of the token.

Field 500*k* contains a value indicating an estimated steering reaction time of the driver of the transmitting vehicle. Factors affecting this value may include data gathered over time indicating the average angular steering wheel speed during turns, the average angle through which the wheel is turned per unit of steering wheel angular speed, the average time between detection of a road obstacle by the vehicle sensors and execution of a turn by the driver, and other pertinent information. Data from each of the sensor readings or variables used for assessing estimated steering reaction time may be quantified and subjected to a sensor fusion process (using a Kalman filter, for example) or otherwise integrated to form a composite value representing an estimated engagement level of the driver. This value is included in field 500*k* of the token.

Field 500*m* contains a value indicating an estimated acceleration reaction time of the driver of the transmitting vehicle. Factors affecting this value may include data gathered over time indicating the average speed or force with which the driver operates the accelerator pedal, and other pertinent information. Data from each of the sensor readings or variables used for assessing estimated acceleration reaction time may be quantified and subjected to a sensor fusion process (using a Kalman filter, for example) or otherwise integrated to form a composite value representing an estimated acceleration reaction time of the driver. Deviation from estimated normal ranges of this parameter may also indicate inattentiveness or lack of perception of the driver to the events Data from each of the sensor readings or variables used for assessing estimated acceleration reaction time may be quantified and subjected to a sensor fusion process (using a Kalman filter, for example) or otherwise integrated to form a composite value representing an estimated engagement level of the driver. This value is included in field 500*m* of the token.

One or more of the sensors providing data for use in driver engagement assessment may also provide data for use in computing assessment of braking reaction time, steering reaction time, and/or acceleration reaction time.

Field 500*n* contains a value indicating an estimated driver engagement level of the driver of the transmitting vehicle. Driver engagement may be generally defined as the degree of mental focus of the driver on the task of driving. For example, factors which may diminish driver engagement are distractions such as multi-tasking, texting on a cellular device, and similar activities which draw the driver's attention away from the task of driving. As stated previously, vehicle sensors such as, for example, internal cameras, may detect conditions which may affect driver engagement, such as the number of the passengers and the types of passengers (e.g. adults, children, teenagers, pets, etc.) in the vehicles, and other potential sources of driver distraction within the vehicle (e.g., pets, phone usage, unsecured objects in the vehicle). Other Sensors 211 and 221 may also be configured to collect data a driver's movements, such as the driver's eye position and/or head position, etc. Other sensors 211 and 221 may collect data regarding the physical or mental state of the driver, such as fatigue or intoxication (i.e., through sensors that detect the content of alcohol in the air or blood alcohol content of the driver, such as a breathalyzer). These and other factors may affect driver engagement.

Data from each of the sensor readings or variables used for assessing driver engagement may be quantified and subjected to a sensor fusion process (using a Kalman filter, for example) or otherwise integrated to form a composite value representing an estimated engagement level of the driver. This value is included in field 500*n* of the token.

Field 500*p* contains a value indicating an estimated driver perception level of the driver of the transmitting vehicle. Factors relating to driver perception may include, for example, visibility of the driving environment (which may be impaired by fog or rain, and which may be detected by external sensors), the total amount of time the driver spends viewing the road (which promotes perception of the driving environment and helps avoid sudden dangerous traffic or road conditions, and which may be detected by internal sensors). Data from each of the sensor readings or variables used for assessing driver perception may also be quantified and subjected to a sensor fusion process (using a Kalman filter, for example) or otherwise integrated to form a composite value representing an estimated engagement level of the driver. This value is included in field 500*p* of the token.

In alternative embodiment, the token 500 may contain additional information in one or more fields 500*r* for use in generating the hazard assessment. Similarly the various computing devices described herein may be configured to process any additional information contained in the token, for purposes of generating the hazard assessment. For example, the state or usage of the transmitting vehicle's controls and instruments may also be transmitted, for example, whether the transmitting vehicle is braking, turning, and by how much, and/or which of the vehicle's instruments are currently activated by the driver (e.g., head lights, turn signals, hazard lights, cruise control, 4-wheel drive, traction control, etc.). Vehicle warnings such as a detection by the transmitting vehicle's internal systems that the vehicle is skidding, that an impact has occurred, or that the vehicle's airbags have been deployed, also may be transmitted in V2V communications. In various other examples, any data collected by any vehicle sensors potentially may be transmitted via V2V communication to other nearby receiving vehicles receiving V2V communications from communication systems 212 and 222.

In certain examples, the nodes in a V2V communication system (e.g., vehicles and other reception devices) may use internal clocks with synchronized time signals, and may send transmission times within V2V communications, so that the receiving vehicle may calculate its distance from the transmitting vehicle based on the difference between the transmission time and the reception time.

As shown in FIG. 2, the data collected by vehicle sensors 211 and 221 also may be processed to generate a hazard assessment token and the token transmitted to one or more external devices via telematics devices 213 and 223. Telematics devices 213 and 223 may be computing devices containing any or all of the hardware/software components as the computing device 14 depicted in FIG. 1. The telematics devices 213 and 223 may be configured to receive hazard assessment information and other information from vehicle sensors 211 and 221, to generate a hazard assessment token using this information, and to transmit the token to one or more vehicles, external computer systems or devices over a wireless transmission network. Telematics devices 213 and 223 also may be configured to detect or determine additional types of information relating to real-time driving and the condition of the vehicles 210 and 220. In certain embodiments, the telematics devices 213 and 223 may contain or may be integral with one or more of the vehicle sensors 211 and 221. The telematics devices 213 and 223 also may store the type of their respective vehicles 210 and 220, for example, the make, model, trim (or sub-model), year, and/or engine specifications, as well as other information such as vehicle owner or driver information and other information for the vehicles 210 and 220.

In certain embodiments, mobile computing devices 215 and 225 within the vehicles 210 and 220 may be used to collect hazard assessment information and/or to receive hazard assessment information from sensors 211 and 221, to generate hazard assessment tokens, and then to transmit the tokens to the other vehicles and external computing devices. In certain embodiments, mobile computing devices 215 and 225 within the vehicles 210 and 220 may also be used to analyze hazard assessment information, to generate hazard assessments, to display hazard assessments, and to generate warnings related to the hazard assessments. Mobile computing devices 215 and 225 may be, for example, mobile phones, personal digital assistants (PDAs), or tablet computers of the drivers or passengers of vehicles 210 and 220. Software applications executing on mobile devices 215 and 225 may be configured to detect certain hazard assessment information independently and/or may communicate with vehicle sensors 211 and 221 to receive additional hazard assessment information. For example, mobile devices 215 and 225 equipped with GPS functionality may determine vehicle location, speed, direction and other basic driving data without needing to communicate with the vehicle sensors 211 or 221, or any vehicle system. In other examples, software on the mobile devices 215 and 225 may be configured to receive some or all of the hazard assessment information collected by vehicle sensors 211 and 221.

In addition, a mobile computing device capable of receiving hazard assessment data and/or other information, generating and transmitting hazard assessment tokens, performing analysis of hazard assessment tokens, generating hazard assessments as described herein, and presenting the analysis results to a driver and/or other vehicle occupant, may be in the form of a device 201 (for example, a watch, wristband or other device) that is wearable by the driver.

When mobile computing devices 215 and 225 within the vehicles 210 and 220 are used to detect hazard assessment information and/or to receive hazard assessment tokens from vehicles 211 and 221, the mobile computing devices 215 and 225 transmit the hazard assessment tokens and/or other information as described herein to one or more other devices. For example, mobile computing devices 215 and 225 may be configured to perform the V2V communications described above, by establishing connections and transmitting/receiving hazard assessment tokens to and from other nearby vehicles. Thus, mobile computing devices 215 and 225 may be used in conjunction with or instead of short-range communication systems 212 and 222 in some examples. Moreover, the processing components of the mobile computing devices 215 and 225 may be used to analyze the information contained in the hazard assessment tokens to calculate hazard assessments and perform other related functions. Therefore, in certain embodiments, mobile computing devices 215 and 225 may be used in conjunction with, or in place of, the hazard assessment computing devices 14 and 114.

As previously described, computing devices 14 and 114 may incorporate hardware and/or software configured to receive hazard assessment tokens from vehicle sensors 211 and 221, short-range communication systems 212 and 222, telematics devices 213 and 223, and/or other sources. After receiving the hazard assessment tokens, hazard assessment computing devices 14 and 114 may perform a set of functions to analyze the hazard assessment information contained in the tokens and calculate hazard assessments. For example, the hazard assessment computing devices 14 and 114 may include one or more hazard assessment analysis calculation algorithms, which may be executed by software running on generic or specialized hardware within the hazard assessment computing devices 14 and 114. The hazard assessment computing device 14 in a first vehicle 210 may use the hazard assessment tokens received from nearby vehicles (including vehicle 220) received via the short-range communication system 212, to calculate hazard assessments applicable to the nearby vehicles. Similarly, within the hazard assessment computing device 114, a hazard assessment calculation function may use hazard assessment tokens received from nearby vehicles (including vehicle 210) to calculate hazard assessments applicable to the nearby vehicles in the local cluster. Thus, the hazard assessment for any transmitting vehicle is a value calculated from the information contained in the latest hazard assessment token received from that vehicle.

Figure 4:
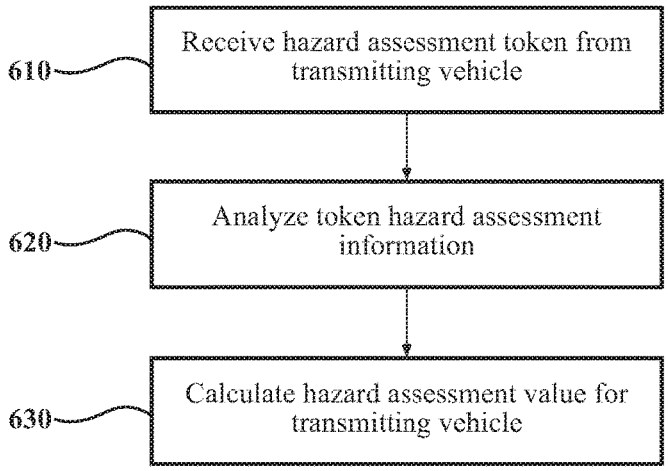
FIG. 4 is a flow diagram showing an example method of processing a hazard assessment token received from a transmitting vehicle.

FIG. 4 is a flow diagram showing an example method of processing a hazard assessment token 500 received from a transmitting vehicle. This process is executed by one of the system computing devices (for example, computing device 14) for each hazard assessment token received from each transmitting vehicle. The one or more of the system computing devices is configured to execute the processes shown in FIGS. 4 and 5 for multiple tokens received from multiple vehicles simultaneously, on a constant or ongoing basis. In this manner, the estimated collision hazards posed by all of the vehicles in the local cluster may be constantly updated.

In block 610, the receiving vehicle receives a hazard assessment token from a transmitting vehicle.

In block 620, the hazard assessment information received in token 500 is analyzed for use in calculating a hazard assessment value. Analysis of the hazard assessment information contained in the token is directed to determining a hazard level value or threat value arising from each of the values found in the hazard assessment token fields 500*a*-500*r*. For example, in certain embodiments, the "x" and "y" coordinate values of the transmitting vehicle (found in fields 500*b* and 500*c*) may be compared to the current "x" and "y" coordinate values of the receiving vehicle, and a relatively higher hazard assessment value assigned to the transmitting vehicle if this vehicle is in relatively closer proximity to the receiving vehicle (i.e., a transmitting vehicle is deemed to present a greater collision threat to the receiving vehicle if it is close to the receiving vehicle).

Similarly, the velocity components vX and vY of a transmitting vehicle (found in fields 500*d* and 500*e*) may be compared to corresponding current velocity components of the receiving vehicle to determine the velocities of the vehicle with respect to each other, and a relatively higher hazard assessment value assigned to the transmitting vehicle if this vehicle is traveling at a high velocity relative to the receiving vehicle (i.e., it is assumed that greater damage would result from a collision if one of the vehicles is traveling at high velocity with respect to the other vehicle).

Also, the acceleration components aX and aY of a transmitting vehicle (found in fields 500*g* and 5000 may be compared to corresponding acceleration components of the receiving vehicle to determine the accelerations of the vehicle with respect to each other. In this case, a relatively higher hazard assessment value may be assigned to the transmitting vehicle if this vehicle has a positive acceleration (i.e., increasing speed) relative to the receiving vehicle.

Also, the path parameter of a transmitting vehicle (found in field 500*h*) may be compared to the projected path of the receiving vehicle. If the path parameters of the vehicle would tend to intersect if extended a certain predetermined distance ahead of the vehicles, a relatively higher hazard assessment value may be assigned to the transmitting vehicle.

In addition, the driver reaction times for braking, steering, and acceleration of the transmitting vehicle may be compared to respective threshold values. If any of these reaction times fall below its respective threshold value, a relatively higher hazard assessment value may be assigned to the transmitting vehicle.

In block 630, a total, sum or composite hazard assessment value (i.e., a hazard assessment) for a transmitting given vehicle is calculated based on analysis of the hazard assessment information appearing in the token most recently received from that vehicle.

For purposes of calculating the hazard assessment, the computing device may assign differing relative weights to the information provided in the various fields 500*a*-500*r* of the token. In one embodiment, the vehicle locational and movement information contained in fields 500*b*-500*h* is given greater weight than the information contained in blocks 500*j*-500*p*. This may be done due to, for example, a relatively greater perceived reliability of the information contained in fields 500*b*-500*h*, the unavailability of the information contained in fields 500*j*-500*p*, or the high relative importance of the transmitting vehicle locational and movement information with regard to collision scenarios.

In one example of weighting, the locational and movement information (contained in fields 500*b*-500*h*) relating to a particular transmitting vehicle may be assigned a relatively greater importance if the receiving vehicle sensors or systems detect conditions indicative of a potential collision between the two vehicles. As a result, the hazard assessment value assigned to the particular transmitting vehicle may be relatively higher that the until the assessment value assigned to other nearby vehicles, until the conditions prompting the heightened threat assessment change.

In block 630, the receiving vehicle calculates, based on the analysis performed in block 620, a hazard assessment value for the vehicle that transmitted the received token.

Figure 5:
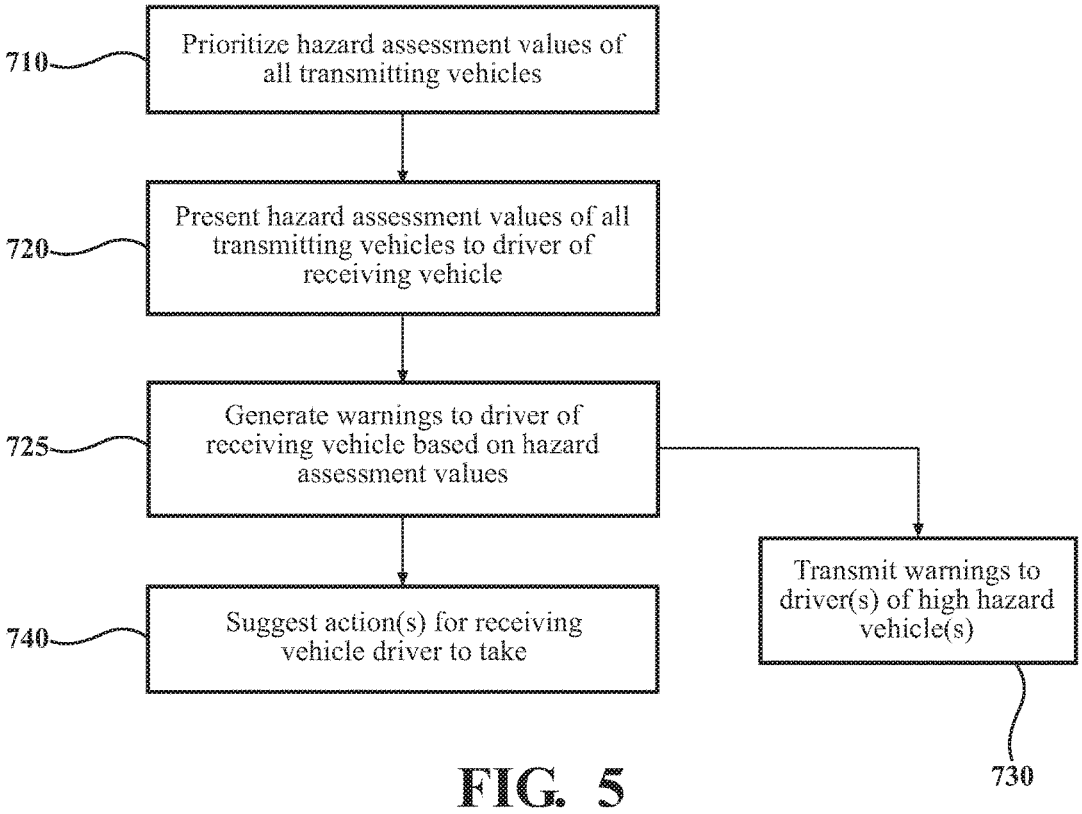
FIG. 5 is a flow diagram showing an example method of processing the hazard assessment values relating to one or more transmitting vehicles, for presentation to the driver of another occupant of the receiving vehicle.

FIG. 5 is a flow diagram showing an example method of processing the hazard assessment values relating to one or more transmitting vehicles, for presentation to the driver of another occupant of the receiving vehicle.

In block 710, a receiving vehicle computing device (such as computing device 14) prioritizes the hazard assessment values of all the transmitting vehicles. For example, a list of all of the hazard assessment values in descending order may be generated. Thus, the greatest hazard will be highest on the list.

Figure 6A:
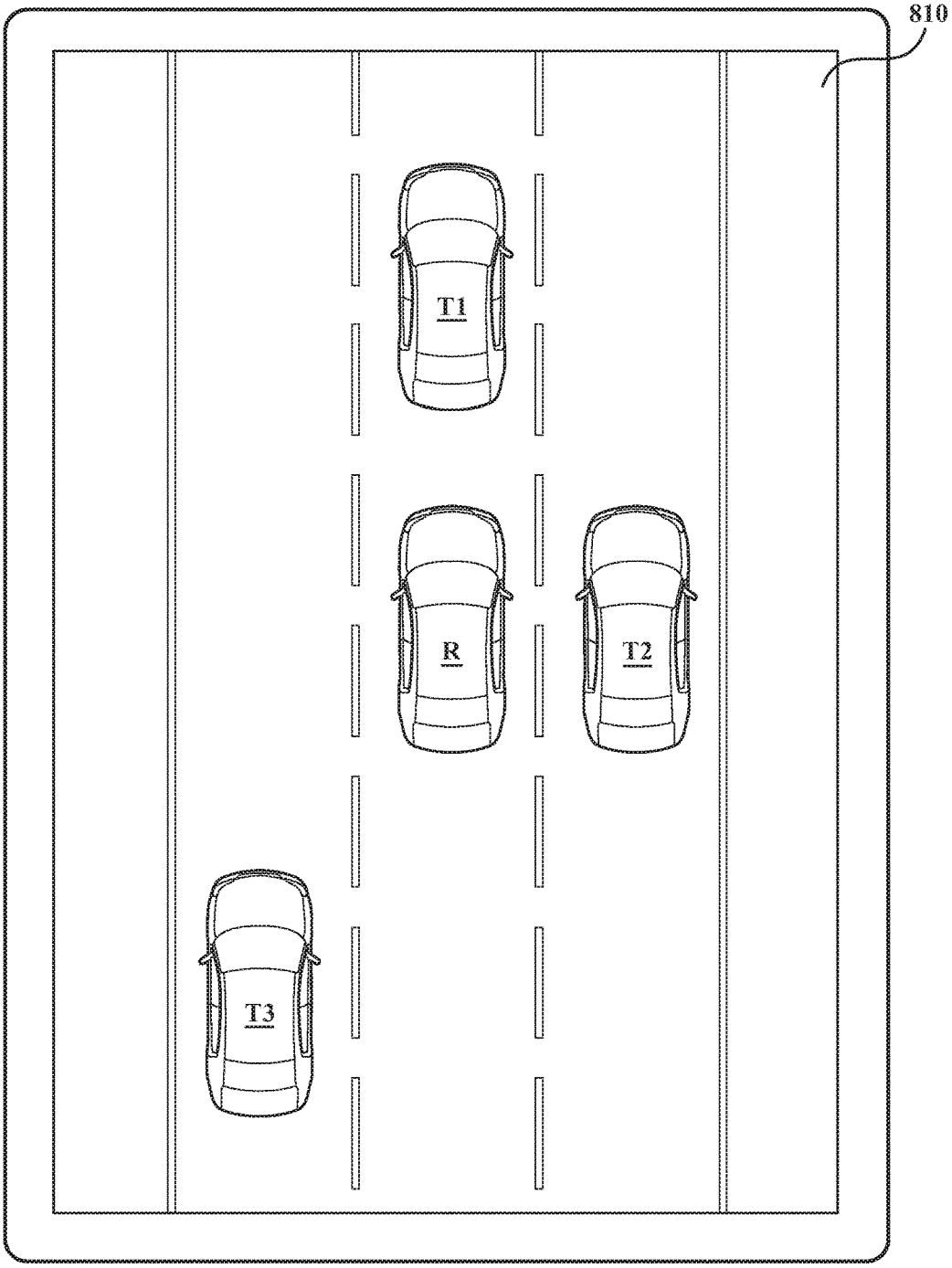
FIG. 6A is one example of a display format usable in presenting hazard assessment values to a vehicle occupant.

In block 720, the prioritized hazard assessment values are presented to the driver and/or another occupant of the receiving vehicle. Presentation of the hazard assessment values may be done in any suitable manner. In one embodiment, the hazard assessment values are presented in visual or graphic form on a display. The display may be an interactive display, such as a touch screen. One exemplary form of such a display is shown in FIG. 6A. The display may show a representation of the roadway on which the receiving vehicle R and the nearby local cluster transmitting vehicles T1, T2, and T3 are driving.

Referring to FIG. 6A, display 810 shows the receiving vehicle R at the center of the screen. The display also shows the current relative road locations or positions of the transmitting vehicles T1, T2, T3 relative to the receiving vehicle R. The display shows the relative positions of the nearby vehicles on the road, thereby providing a clear, rapidly understandable representation of the hazards posed by the nearby vehicles. The hazard assessment value for each transmitting vehicle may be indicated, for example, by a value appearing on the screen next to the associated transmitting vehicle. The presentation of the hazard assessment values may also include an audio component. An identifier may be assigned to each transmitting vehicle, for use in associating a particular transmitting vehicle with its most recently received token and for purposes of presenting the hazard assessment values to the receiving vehicle occupant. For example, the identifier "T1" may be associated with the vehicle having the vehicle ID contained in field 500*a* of the token 500. In the display shown in FIGS. 8A-8C, this vehicle is driving immediately ahead of the receiving vehicle R.

Figure 6B:
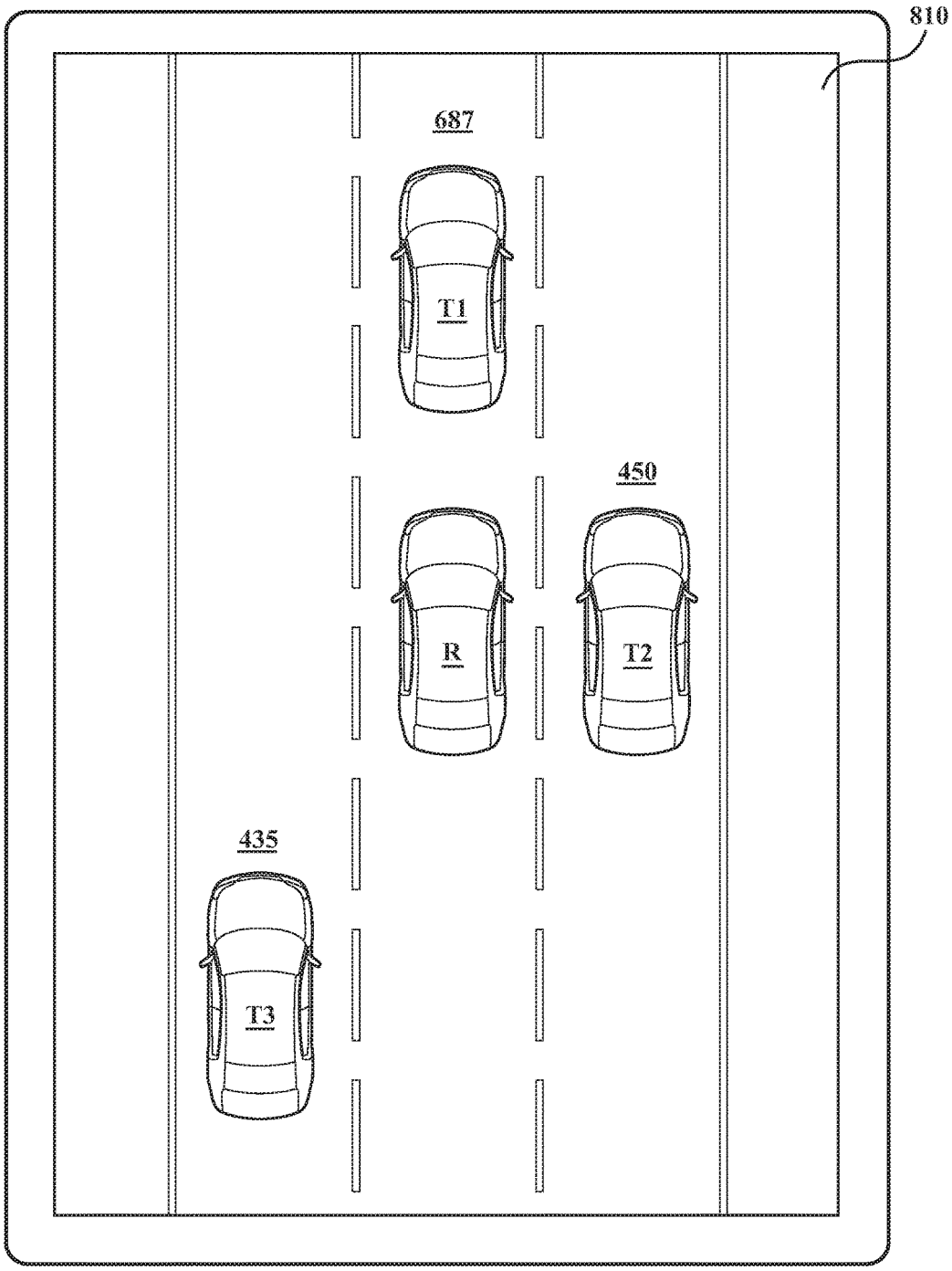
FIG. 6B is another example of a display format usable in presenting hazard assessment values to a vehicle occupant.

Referring to FIG. 6B, in one particular embodiment, the hazard assessment values are presented to the receiving vehicle occupant as a numerical value associated with each transmitting vehicle. The numerical value indicates the relative magnitude of the estimated hazard posed by each vehicle. This numerical value may be (or may be based on) a composite a total or sum of the hazard assessments calculated for each of the parameters in the hazard assessment token, as previously described. Thus, for example, vehicle T1 in FIG. 6B may have a hazard assessment value of 687, vehicle T2 a hazard assessment value of 450, and vehicle T3 a hazard assessment value of 435. Thus, in this scenario, the hazard assessment system indicates to the receiving vehicle occupant that the hazard posed by vehicle T1 is much greater than the hazard posed by vehicles T2 and T3. The driver of vehicle R may then take appropriate steps to further distance vehicle R from vehicle T1, or otherwise to avoid vehicle T1.

Figure 6C:
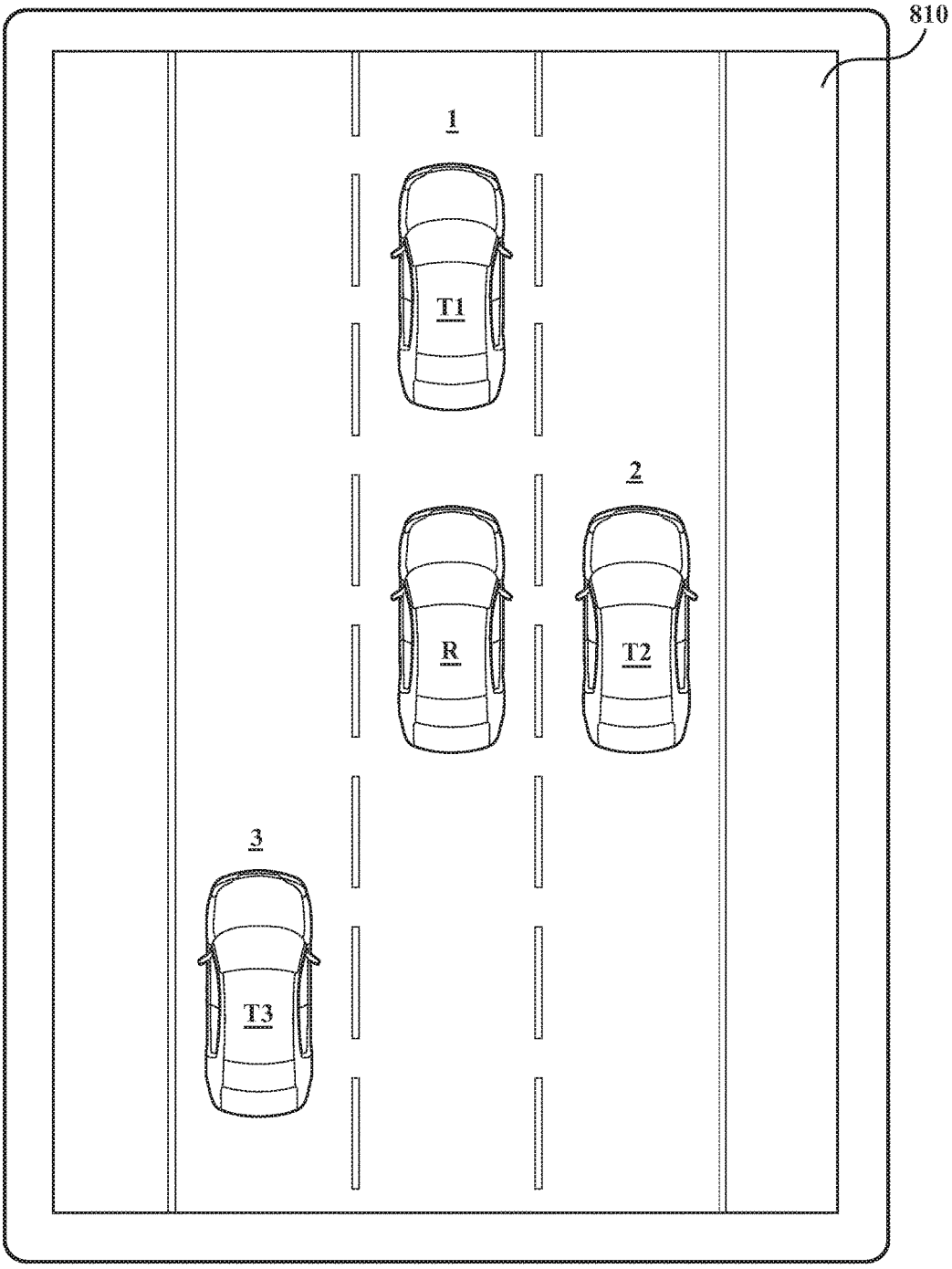
FIG. 6C is another example of a display format usable in presenting hazard assessment values to a vehicle occupant.

Referring to FIG. 6C, in another embodiment, the hazard assessment values shown on the screen simply reflect the hazard assessment priority assigned to each transmitting vehicle, based on the analysis of the parameters contained in the most recently received hazard assessment token. For example, the transmitting vehicle may be labeled according to their hazard priority as "1", "2", "3", etc.

Other display formats are also possible.

In a particular embodiment, a threshold hazard assessment value may be established above which an enhanced warning is generated for any vehicle with a hazard assessment value above the threshold. For example, screen icons representing relatively higher hazard value vehicles may have a color different from icons representing relatively lower hazard value vehicles. Alternatively, screen icons representing relatively higher hazard value vehicles may blink or flash on and off, while icons representing relatively lower hazard value vehicles are displayed without blinking. In addition to the visual alert, an audible alert may be transmitted to draw the vehicle occupant's attention to relatively higher hazard value vehicles.

Also, an enhanced warning relating to a particular vehicle may be implemented under other conditions, for example, when the vehicle is has the highest hazard assessment value of the nearby vehicles.

In block 725, the hazard avoidance system may also generate warnings to the driver of the receiving vehicle based on the analysis of the hazard assessment token parameters. For example, if it is determined that the distance between the receiving vehicle and vehicle T1 is closing, the hazard avoidance system may transmit an audio message to the driver via HMI 109 stating that "The distance between us and Vehicle T1 is decreasing rapidly". This may enable the receiving vehicle to take avoidance action if she is unable to look at a visual display while driving. Other messages may also be transmitted to the driver and/or occupant (for example, a message urging the driver to stay calm).

In block 730, the hazard avoidance system may also generate warnings to the drivers of one or more of the transmitting vehicles based on the analysis of the hazard assessment token parameters. This may enable a transmitting vehicle(s) to alter driving behaviors that may be contributing to a collision hazard according to the receiving vehicle analysis of the hazard assessment token received from the transmitting vehicle(s). The messages may be sent in any suitable form, for example, audio, text, etc., and may be transmitted over the V2V communications system or over a cellular or other wireless system, for example.

Referring again to FIG. 5, in block 740, the hazard avoidance system may suggest to the driver of the receiving vehicle one or more actions to take to reduce or avoid the hazards posed by one or more of nearby vehicles T1-T3. For instance, in the example shown in FIGS. 8A-8C, the driver may receive an audio message advising the driver to decrease speed in order to increase the following distance between the receiving vehicle R and vehicle T1.

Figure 6D:
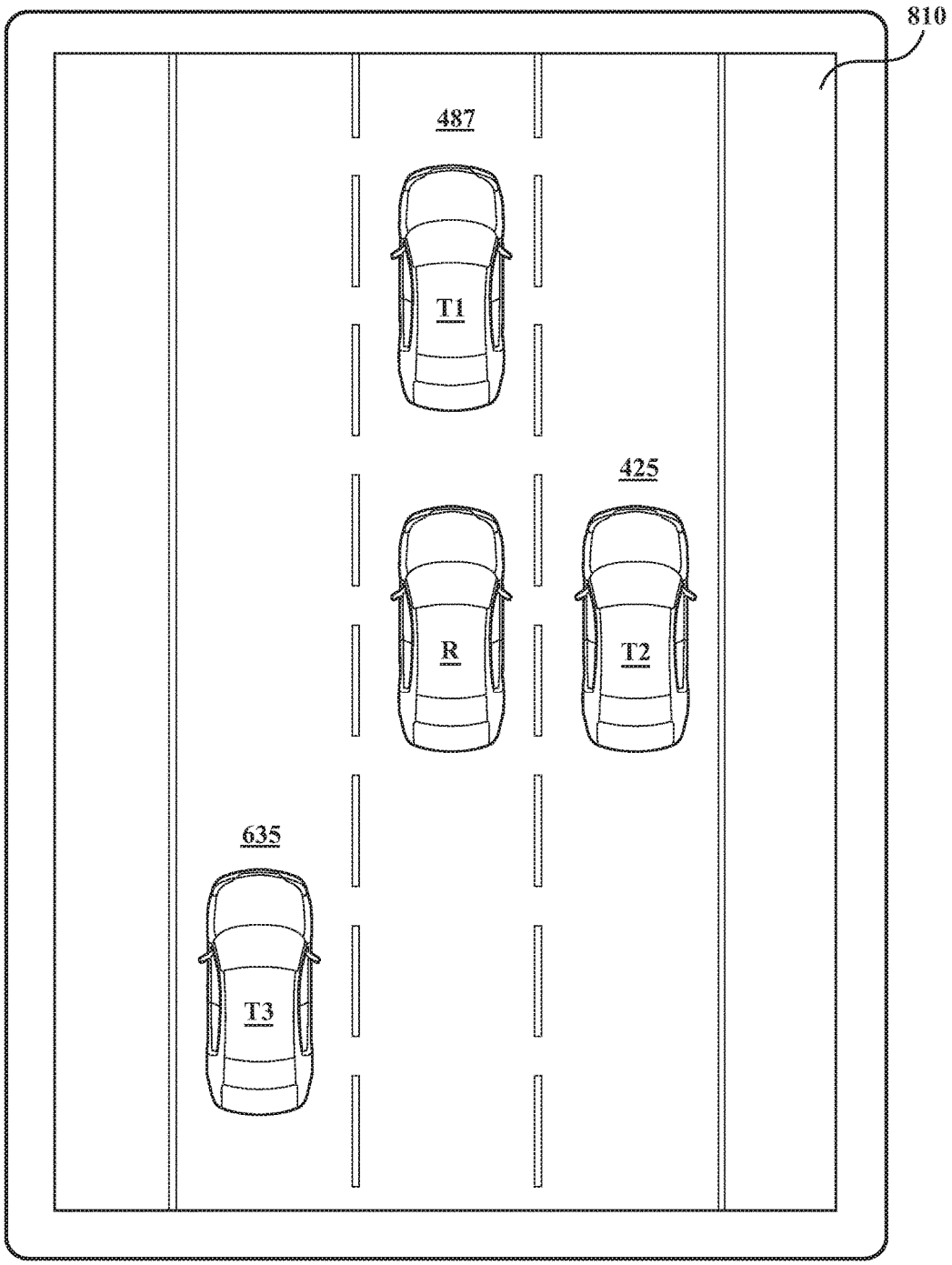
FIG. 6D shows the display of FIG. 6B at a later point in time.

FIG. 6D shows the embodiment of FIG. 6B after the receiving vehicle R receives one or more updated hazard assessment tokens from one or more of vehicles T1-T3.

For example, FIG. 6B may show the vehicles in the local cluster at time t1, while FIG. 8D shows the vehicle in the cluster at a time t2 after t1. The elapsed time between the scenarios shown may be only a few seconds. In FIG. 6D, the hazard assessment value relating to vehicle T1 has decreased from 687 to 487, while the hazard assessment value relating to vehicle T3 has increased from 435 to 635. This is because the hazard assessment tokens are generated by and received from the transmitting vehicles T1-T3 on an ongoing basis, and updated values of the hazard assessment are also calculated on an ongoing basis using the new hazard assessment tokens. Therefore, FIG. 6D illustrates the rapidity with which the hazard assessment values of the vehicles T1-T3 can change in correspondence with changes in the information contained in the updated hazard assessment tokens.

While the aspects described herein have been discussed with respect to specific examples including various modes of carrying out aspects of the disclosure, those skilled in the art will appreciate that there are numerous variations and permutations of the above described systems and techniques that fall within the spirit and scope of the invention.

What is claimed is:

1. A computing device for a hazard avoidance system for a vehicle, the computing device comprising one or more processors for controlling operation of the computing device, and a memory storing computer-executable instructions which, when executed by the one or more processors, cause the computing device to:

receive hazard assessment information transmitted from at least one transmitting vehicle residing within a predetermined distance from the vehicle, the hazard assessment information relating to the at least one transmitting vehicle, the hazard assessment information including information relating to the driver of the at least one transmitting vehicle;

analyze the received hazard assessment information to generate a hazard assessment value relating to the at least one transmitting vehicle;

compare the hazard assessment value relating to the at least one transmitting vehicle to a threshold hazard assessment value;

responsive to a result of comparing the hazard assessment value relating to the at least one transmitting vehicle to the threshold hazard assessment value, generate a warning to the at least one transmitting vehicle regarding the hazard assessment value relating to the at least one transmitting vehicle;

acquire hazard assessment information relating to the vehicle;

generate, using the hazard assessment information relating to the vehicle, a hazard assessment token including at least one of a value indicating an estimated braking reaction time of a driver of the vehicle, a value indicating an estimated steering reaction time of the driver of the vehicle, a value indicating an estimated acceleration reaction time of the driver of the vehicle, a value indicating an estimated driver engagement level of the driver of the vehicle, and a value indicating an estimated driver perception level of the driver of the vehicle; and transmit the hazard assessment token to at least one other vehicle traveling within the predetermined distance from the vehicle, wherein the information relating to the driver of the at least one transmitting vehicle includes at least one of a value indicating an estimated braking reaction time of a driver of the at least one transmitting vehicle, a value indicating an estimated steering reaction time of the driver of the transmitting vehicle, and a value indicating an estimated acceleration reaction time of the driver of the transmitting vehicle.

2. The computing device of claim 1 storing additional computer-executable instructions which, when executed by the one or more processors, cause the hazard avoidance computing device to generate a warning to an occupant of the vehicle.

3. The computing device of claim 1 wherein the hazard assessment information relating to the at least one transmitting vehicle includes "x" and "y" position coordinate values of the at least one transmitting vehicle, and wherein the computing device stores additional computer-executable instructions which, when executed by the one or more processors, cause the hazard avoidance computing device to:

receive "x" and "y" coordinate values of the vehicle; and compare "x" and "y" coordinate values of the at least one transmitting vehicle to the associated "x" and "y" coordinate values of the vehicle when analyzing the hazard assessment information.

4. A computing device for a hazard avoidance system for a vehicle, the computing device comprising one or more processors for controlling operation of the computing device, and a memory storing computer-executable instructions which, when executed by the one or more processors, cause the hazard avoidance computing device to:

receive hazard assessment information transmitted from at least one transmitting vehicle residing within a predetermined distance from the vehicle, the hazard assessment information relating to the at least one transmitting vehicle, the hazard assessment information including a velocity component of the at least one transmitting vehicle in an "x" reference direction and a velocity component of the at least one transmitting vehicle in a "y" reference direction, the hazard assessment information relating to the at least one transmitting vehicle also including an acceleration component of the at least one transmitting vehicle in an "x" reference direction and an acceleration component of the at least one transmitting vehicle in a "y" reference direction;

receive a velocity component of the vehicle in the "x" reference direction;

receive a velocity component of the vehicle in the "y" reference direction;

receive an acceleration component in the "x" reference direction of the vehicle;

receive an acceleration component of the vehicle in the "y" reference direction;

analyze the received hazard assessment information, the analysis including comparing "x" and "y" velocity components of the vehicle to the associated "x" and "y" velocity components of the at least one transmitting vehicle when analyzing the hazard assessment information, and also comparing "x" and "y" acceleration components of the vehicle to the associated "x" and "y" acceleration components of the at least one transmitting vehicle when analyzing the hazard assessment information;

using the analysis of the received hazard assessment information, generate a hazard assessment value relating to the at least one transmitting vehicle;

compare the hazard assessment value relating to the at least one transmitting vehicle to a threshold hazard assessment value; and responsive to a result of comparing the hazard assessment value relating to the at least one transmitting vehicle to the threshold hazard assessment value, generate a warning to the at least one transmitting vehicle regarding the hazard assessment value relating to the at least one transmitting vehicle.

5. A vehicle hazard avoidance system including a computing device in accordance with claim 1.

6. A vehicle including a computing device in accordance with claim 1.

7. A method for estimating a collision hazard to a first vehicle posed by at least one other vehicle driving within a predetermined distance of the first vehicle, the method comprising steps of:

receiving, in the first vehicle, hazard assessment information transmitted from the at least one other vehicle, the hazard assessment information relating to the at least one other vehicle, the hazard assessment information including information relating to the driver of the at least one other vehicle;

analyzing the received hazard assessment information to generate a hazard assessment value relating to the at least one other vehicle;

comparing the hazard assessment value relating to the at least one other vehicle to a threshold hazard assessment value;

responsive to a result of comparing the hazard assessment value relating to the at least one other vehicle to the threshold hazard assessment value, generating a warning to the at least one other vehicle regarding the hazard assessment value relating to the at least one other vehicle;

acquiring hazard assessment information relating to the first vehicle;

generating, using the hazard assessment information relating to the first vehicle, a hazard assessment token including at least one of a value indicating an estimated braking reaction time of a driver of the vehicle, a value indicating an estimated steering reaction time of the driver of the vehicle, a value indicating an estimated acceleration reaction time of the driver of the vehicle, a value indicating an estimated driver engagement level of the driver of the vehicle, and a value indicating an estimated driver perception level of the driver of the vehicle; and transmitting the hazard assessment token to at least one other vehicle traveling within the predetermined distance from the first vehicle, wherein the information relating to the driver of the at least one transmitting vehicle includes at least one of a value indicating an estimated braking reaction time of a driver of the at least one transmitting vehicle, a value indicating an estimated steering reaction time of the driver of the transmitting vehicle, and a value indicating an estimated acceleration reaction time of the driver of the transmitting vehicle.

8. A vehicle hazard avoidance system including a computing device comprising one or more processors for controlling operation of the computing device, and a memory storing computer-executable instructions which, when executed by the one or more processors, cause the hazard avoidance computing device to:

receive hazard assessment information transmitted from at least one transmitting vehicle residing within a predetermined distance from the vehicle, the hazard assessment information relating to the at least one transmitting vehicle, the hazard assessment information including a velocity component of the at least one transmitting vehicle in an "x" reference direction and a velocity component of the at least one transmitting vehicle in a "y" reference direction, the hazard assessment information relating to the at least one transmitting vehicle also including an acceleration component of the at least one transmitting vehicle in an "x" reference direction and an acceleration component of the at least one transmitting vehicle in a "y" reference direction;

receive a velocity component of the vehicle in the "x" reference direction;

receive a velocity component of the vehicle in the "y" reference direction;

receive an acceleration component in the "x" reference direction of the vehicle;

receive an acceleration component of the vehicle in the "y" reference direction;

analyze the received hazard assessment information, the analysis including comparing "x" and "y" velocity components of the vehicle to the associated "x" and "y" velocity components of the at least one transmitting vehicle when analyzing the hazard assessment information, and also comparing "x" and "y" acceleration components of the vehicle to the associated "x" and "y"

acceleration components of the at least one transmitting vehicle when analyzing the hazard assessment information;

using the analysis of the received hazard assessment information, generate a hazard assessment value relating to the at least one transmitting vehicle;

compare the hazard assessment value relating to the at least one transmitting vehicle to a threshold hazard assessment value; and responsive to a result of comparing the hazard assessment value relating to the at least one transmitting vehicle to the threshold hazard assessment value, generate a warning to the at least one transmitting vehicle regarding the hazard assessment value relating to the at least one transmitting vehicle.

9. A vehicle including a computing device comprising one or more processors for controlling operation of the computing device, and a memory storing computer-executable instructions which, when executed by the one or more processors, cause the hazard avoidance computing device to:

receive hazard assessment information transmitted from at least one transmitting vehicle residing within a predetermined distance from the vehicle, the hazard assessment information relating to the at least one transmitting vehicle, the hazard assessment information including a velocity component of the at least one transmitting vehicle in an "x" reference direction and a velocity component of the at least one transmitting vehicle in a "y" reference direction, the hazard assessment information relating to the at least one transmitting vehicle also including an acceleration component of the at least one transmitting vehicle in an "x" reference direction and an acceleration component of the at least one transmitting vehicle in a "y" reference direction;

receive a velocity component of the vehicle in the "x" reference direction;

receive a velocity component of the vehicle in the "y" reference direction;

receive an acceleration component in the "x" reference direction of the vehicle;

receive an acceleration component of the vehicle in the "y" reference direction;

analyze the received hazard assessment information, the analysis including comparing "x" and "y" velocity components of the vehicle to the associated "x" and "y" velocity components of the at least one transmitting vehicle when analyzing the hazard assessment information, and also comparing "x" and "y" acceleration components of the vehicle to the associated "x" and "y" acceleration components of the at least one transmitting vehicle when analyzing the hazard assessment information;

using the analysis of the received hazard assessment information, generate a hazard assessment value relating to the at least one transmitting vehicle;

compare the hazard assessment value relating to the at least one transmitting vehicle to a threshold hazard assessment value; and responsive to a result of comparing the hazard assessment value relating to the at least one transmitting vehicle to the threshold hazard assessment value, generate a warning to the at least one transmitting vehicle regarding the hazard assessment value relating to the at least one transmitting vehicle.

10. The computing device of claim 1 wherein the information relating to the driver of the at least one transmitting vehicle includes a value indicating an estimated driver perception level of the driver of the at least one transmitting vehicle.

11. The computing device of claim 10 wherein the information relating to the driver of the at least one transmitting vehicle includes a value indicating an estimated driver engagement level of a driver of the at least one transmitting vehicle.

12. The computing device of claim 1 wherein the memory includes computer-executable instructions which, when executed by the one or more processors, cause the computing device to, responsive to the result of comparing the hazard assessment value relating to the at least one transmitting vehicle to the threshold hazard assessment value, generate a warning to at least one other transmitting vehicle different from the at least one transmitting vehicle regarding the hazard assessment value relating to the at least one transmitting vehicle, the at least one other transmitting vehicle residing within the predetermined distance of the vehicle.

* * * * *